US005635465A

United States Patent [19]

Sobata et al.

[11] Patent Number: 5,635,465

[45] Date of Patent: Jun. 3, 1997

[54] ALKALINE DEGREASING SOLUTION

[75] Inventors: Tamotsu Sobata, Ibaraki; Naohiko Sumie, Kobe, both of Japan

[73] Assignee: Nippon Paint Co., Ltd., Osaka, Japan

[21] Appl. No.: 398,801

[22] Filed: Mar. 6, 1995

[30] Foreign Application Priority Data

Mar. 18, 1994 [JP] Japan ..... 6-049345

[51] Int. Cl.[6] ..... C11D 1/66; C11D 3/34

[52] U.S. Cl. ..... 510/274; 510/254; 510/258; 510/245; 510/365; 510/421; 510/493

[58] Field of Search ..... 252/174.21, 106, 252/156, 135, 174.14; 510/245, 254, 258, 274, 365, 421, 493

[56] References Cited

U.S. PATENT DOCUMENTS

| | | | |
|---|---|---|---|
| 2,814,597 | 11/1957 | Wenneis et al. | 252/107 |
| 3,145,179 | 8/1964 | Mitoray et al. | 252/107 |
| 3,471,576 | 10/1969 | Klesper et al. | 260/619 |
| 3,485,919 | 12/1969 | Markgraf et al. | 424/322 |
| 3,538,138 | 11/1970 | Dunbar | 260/453 |
| 3,606,990 | 9/1971 | Gobert et al. | 8/111 |
| 4,349,448 | 9/1982 | Steele | 252/135 |
| 4,445,940 | 5/1984 | Hulford et al. | 134/2 |
| 5,352,387 | 10/1994 | Rahman et al. | 252/548 |
| 5,358,656 | 10/1994 | Humphreys et al. | 252/174.12 |

FOREIGN PATENT DOCUMENTS

| | | |
|---|---|---|
| 541034 | 5/1993 | European Pat. Off. . |
| 02539V | 8/1973 | Germany . |
| 53-145353 | 12/1978 | Japan . |
| 8056579 | 2/1982 | Japan . |
| 0251985 | 12/1985 | Japan . |

OTHER PUBLICATIONS

Database WPI, Derwent Publications, Ltd., 15 Jun. 1984, Bul. 22; "Compsn. for Cleaning Metal Surfaces —Contains Specified Cationite and Additional Specified Anionite, and Water"; Lengd Pigment Production.

*Primary Examiner*—Paul Lieberman
*Assistant Examiner*—Michael P. Tierney
*Attorney, Agent, or Firm*—Townsend & Banta

[57] ABSTRACT

An alkaline degreasing aqueous solution containing 0.01 to 10 g/l of a nonionic surface-active agent, and an organic substance exhibiting water solubility or water dispersibility at a pH value of at least 8, having a phenolic hydroxyl group with a molecular weight of at least 500, at a weight ratio of 0.1 to 2:1=(organic substance having a phenolic hydroxyl group):(nonionic surface-active agent). The alkaline degreasing aqueous solution has a pH value of at least 8.

8 Claims, 1 Drawing Sheet

ALKALINE DEGREASING SOLUTION

BACKGROUND OF THE INVENTION

1. Field of the Invention

The present invention relates to an alkaline degreasing solution for degreasing the surface of a metal material such as iron, zinc, aluminum or an alloy thereof, or a non-metal material such as plastic or glass.

2. Description of the Background Art

In general, a degreasing treatment is carried out in order to remove fats and oils such as mineral oils and/or flora and fauna oils adhering to the surface of a target such as a metal material or a non-metal material, as a pretreatment for plating or coating, or simply for cleaning the surface. A cleaning solution which is employed for the degreasing treatment generally contains a builder mainly consisting of acid or alkali and a nonionic or anionic surface-active agent. As to waste water resulting from such a degreasing treatment, the COD value, oil concentration and the like are regulated, in order to maintain lake water or the like in good quality. In relation to waste water containing a surface-active agent, particularly a nonionic surface-active agent, however, it is well known that the surface-active agent can hardly be removed through neutralizing coagulation employing a general coagulant such as aluminum sulfate or iron chloride. In this case, therefore, the COD value is not reduced and the oil concentration cannot be sufficiently reduced either. Under the present circumstances, treated water which is passed through a neutralizing coagulation step is pretreated by dilution or the like, and thereafter subjected to an activated sludge treatment and an activated charcoal absorption treatment. Further, since a conventional degreasing solution which is reduced in degreasability due to aging is hard to treat, the same is generally diluted with water of 10 to 100 times in volume to be thereafter treated.

In relation to treatment of such waste water containing a surface-active agent, each of Japanese Patent Laying-Open No. 48-56579 (1973) and Japanese Patent Publication No. 60-251985 (1985) proposes a method of carrying out neutralizing coagulation by adding an organic substance having a phenolic hydroxyl group and an inorganic coagulant to the waste water.

Further, Japanese Patent Laying-Open No. 48-56579 discloses a method of treating waste water containing a surface-active agent with both of an organic substance having a phenolic hydroxyl group and an inorganic or organic coagulant.

On the other hand, Japanese Patent Publication No. 60-251985 discloses a method of adding a condensate obtained by a reaction of dihydroxydiphenylsulfone, lower aliphatic aldehyde and alkaline metal hydrogensulfite or alkaline metal sulfite to waste water containing a surface-active agent and thereafter adding a coagulant thereto.

In each of the aforementioned methods, however, it is necessary to add the treatment agent corresponding to the amount of the surface-active agent contained in the waste water, and hence the concentration of this surface-active agent must be measured before the addition of the treatment agent. If the treatment agent is excessively added, this treatment agent disadvantageously increases the COD value.

Further, it is necessary to sufficiently react the added treatment agent with the surface-active agent, and hence additional equipment and time are required for such reaction and the treatment steps are complicated.

SUMMARY OF THE INVENTION

An object of the present invention is to provide an alkaline degreasing solution which enables a simple waste water treatment, without causing the aforementioned problems.

The inventors have conductive extensive research for solving the aforementioned problems of the prior art, and discovered that it is possible to obtain an alkaline degreasing solution which enables efficient waste water treatment by previously adding a prescribed volume of an organic substance having a phenolic hydroxyl group to an alkaline degreasing solution containing a nonionic surface-active agent, to attain the present invention.

An alkaline degreasing solution according to the present invention contains 0.01 to 10 g/l of a nonionic surface-active agent, and an organic substance exhibiting water solubility or water dispersibility at a pH value of at least 8, having a phenolic hydroxyl group with a molecular weight of at least 500, at a weight ratio of 0.1 to 2:1=(organic substance having a phenolic hydroxyl group):(nonionic surface-active agent), and this alkaline degreasing solution has a pH value of at least 8.

The organic substance having a phenolic hydroxyl group which is employed in the present invention has a molecular weight of at least 500, and exhibits water solubility or water dispersibility at a pH value of at least 8. Water solubility or water dispersibility is attained at the concentration of the organic substance in the inventive alkaline degreasing solution, which is demanded so as not to hinder the function of the alkaline degreasing solution.

The molecular weight of the organic substance having a phenolic hydroxyl group in the present invention is at least 500, and preferably in the range of 500 to 5000. If the molecular weight of this organic substance is less than 500, due to an excess degree of water solubilization, an effect of coagulating the nonionic surface-active agent in a step of waste water neutralizing coagulation may be so reduced that a sufficient effect cannot be attained in the waste water treatment. If the molecular weight exceeds 5000, on the other hand, the inventive degreasing solution may be rendered slightly soluble that the same adheres to the target to exert a bad influence on the degreasing treatment, or the effective concentration of the same for coagulating the surface-active agent may be reduced so that sufficient effect of the waste water treatment is not obtained.

Examples of the aforementioned organic substance having a phenolic hydroxyl group are a condensate of phenols and aldehydes, and a condensate of polyhydric alcohols and polysaccharides.

The phenol-aldehyde condensate is obtained by reacting phenols such as phenol, o-cresol, p-cresol, bromophenol, methylphenol, pyrogallol, diphenol, dioxyphenylpropane and dihydroxydiphenylsulfone, and aldehydes such as formaldehyde, acetaldehyde, butylaldehyde and paraformaldehyde with an acidic or alkaline catalyst. The condensation number of the phenol in such a condensate is preferably about 2 to 10, and more preferably about 3 to 6. If the condensation number of the phenol is too small, the molecular weight of the organic substance is too small and the effect of coagulating the nonionic surface-active agent may be so reduced that a sufficient effect cannot be attained in the waste water treatment. If the condensation number of the phenol is too large, on the other hand, the degreasing solution may be hardly soluble at a pH value of at least 8.

The phenol-aldehyde condensate is preferably a condensate of phenols such as bis(hydroxyphenyl)sulfone and aldehydes such as formaldehyde, and most preferably a formalin condensate of sodium bis(hydroxyphenyl) sulfonemonomethylsulfonate. An example of such a condensate is disclosed in Japanese Patent Publication No. 60-251985. This condensate is a condensation polymer which is obtained by reacting dihydroxydiphenylsulfone such as 4,4'-dihydroxydiphenylsulfone, a lower aliphatic aldehyde having carbon number of 1 to 3 such as formaldehyde, and alkaline metal hydrogensulfite or alkaline metal sulfite, which condensation polymer has a mean molecular weight of 500 to 2000, with 0.05 to 0.7 sulfoalkyl group expressed in a general formula —$CH(R^1)$—$SO_3M$, where $R^1$ represents a hydrogen atom or an alkyl group having a carbon number of 1 or 2 and M represents a hydrogen atom or an alkyl metal, on the average with respect to one dihydroxydiphenylsulfone.

Examples of the condensate of a polyhydric phenol and a polysaccharide are synthetic or natural tannic acid which is a condensate of gallic acid and glucose, and a condensate of pyrogallol and glucose.

The nonionic surface-active agent employed in the present invention may be prepared from that generally employed for an alkaline degreasing solution, such as alkylates of alkylphenol, alkylates of higher alcohol, higher fatty acid esters, higher fatty acid amide ethers or polyalkylene ethers. In particular, the nonionic surface-active agent employed in the present invention preferably has degreasability and low foamability, with a clouding point of 25° to 50° C.

The alkaline degreasing solution according to the present invention contains 0.01 to 10 g/l of the nonionic surface-active agent, preferably in the range of 0.1 to 5 g/l. The degreasability is insufficient if the content of the nonionic surface-active agent is too small, while no further degreasability can be attained but the COD value is so increased in the waste water that the cost for the waste water treatment is increased if the content of the nonionic surface-active agent is in excess of the aforementioned range.

Further, the alkaline degreasing solution according to the present invention contains the organic substance having a phenolic hydroxyl group at a weight ratio of 0.1 to 2:1= (organic substance having a phenolic hydroxyl group): (nonionic surface-active agent). If the content of the organic substance having a phenolic hydroxyl group is lower than 0.1 in weight ratio, neutralizing coagulation cannot be sufficiently carried out and hence it is impossible to sufficiently reduce the COD value and the oil concentration in the waste water. If the weight ratio exceeds 2, on the other hand, no further effect of the neutralizing coagulation can be attained despite the increased cost, while the COD value of the waste water is disadvantageously increased.

The alkaline degreasing solution according to the present invention has a pH value of at least 8, preferably in the range of 10.5 to 12.5. If the pH value is less than 8, the nonionic surface-active agent and the organic substance having a phenolic hydroxyl group in the alkaline degreasing solution may be reacted with each other to cause neutralizing coagulation, leading to reduction of the degreasability. The pH value is preferably at least 10.5, in consideration of oil contamination resistance. If the pH value exceeds 12.5, however, a metal material such as aluminum or zinc may be dissolved when the same is subjected to the alkaline degreasing treatment. The term "oil contamination resistance" indicates a property which can maintain the degreasability when the alkaline degreasing solution is contaminated by oil.

It is possible to introduce an organic builder into the inventive alkaline degreasing solution, in order to maintain its pH value and to improve the degreasability. Examples of the organic builder are silicates, phosphates, condensed phosphates, carbonates and caustic alkali. Among these examples, it is possible to preferably employ silicates, which have high degreasability and contain neither phosphorus nor nitrogen causing eutrophication, in particular. Examples of silicates are orthosilicic alkaline metallic salts such as sodium orthosilicate and potassium orthosilicate, metasilicic alkaline metallic salts such as sodium metasilicate and potassium metasilicate, and sesquisilicic alkaline metallic salts such as sodium sesquisilicate and potassium sesquisilicate, which can be employed independently or in a combination of at least two materials. The concentration of silicate is preferably in the range of 0.1 to 1 g/l as Si concentration. If the concentration of silicate is less than 0.1 g/l, the degreasability may be insufficiently improved. If the concentration exceeds 1 g/l, on the other hand, a zinc-based metal material to be degreased may deteriorate in chemical conversion property and coating property.

Further, it is possible to introduce water soluble polycarboxylate into the inventive alkaline degreasing solution, in order to further improve the degreasability as well as waste water treatability. The water soluble polycarboxylate is not restricted in particular, so far as the same is dissolved by at least 0.01 g/l in water of at least 0° C. The weight average molecular weight of such polycarboxylate is preferably in the range of 5,000 to 100,000, more preferably in the range of 10,000 to 1000,000. An example of the water soluble polycarboxylate is a homopolymer or a copolymer of a unsaturated carboxylate having one polymeric double bond, and having a carboxyl group which is neutralized with an alkaline metal such as sodium or potassium. If the weight average molecular weight of the polycarboxylate is out of the aforementioned range, the degreasability of the degreasing solution may not be sufficiently improved but reduced.

The content of water soluble polycarboxylate is preferably in the range of 0.01 to 10 g/l. If the content of water soluble polycarboxylate is too small, the degreasability of the degreasing solution may be insufficiently improved. If this content is too large, on the other hand, the degreasing solution may be so thickened that a considerable volume of the solution adheres to the target to be consumed, leading to increase cost.

Examples of the aforementioned water soluble polycarboxylate are available as the following commercial products:

[Products by BASF Ltd.]

Sokaran CP-5 . . . resin solution containing 40 percent by weight of sodium salt of a copolymer of maleic acid and acrylic acid having a weight average molecular weight of 70,000

Sokaran CP-7 . . . resin solution containing 40 percent by weight of sodium salt of a copolymer of maleic acid and acrylic acid having a weight average molecular weight of 50,000

Sokaran PA-40 . . . resin solution containing 40 percent by weight of sodium polyacrylate having a weight average molecular weight of 15,000

[Products by Kao Corporation]

Poise 520 . . . resin solution containing 40 percent by weight of specific polycarboxylate Poise 521 . . . resin solution containing 40 percent by weight of specific polycarboxylate Poise 531 . . . resin solution containing 40 percent by weight of specific polycarboxylate

[Products by Asahi Denka Kogyo K.K.]

Adekacohol W-193 . . . resin solution containing 25 percent by weight of sodium salt of a diisobutylene/olefin/maleic anhydride copolymer Adekacohol W-304 . . . resin solution containing 40 percent by weight of sodium polyacrylate Adekacohol W-370 . . . resin solution containing 40 percent by weight of sodium salt of a maleic acid-acrylic acid copolymer An alkaline degreasing method employing the inventive alkaline degreasing solution can be carried out similarly to a ordinary degreasing process, and not restricted in particular. For example, the degreasing treatment can be carried out at a treatment temperature of 20° to 60° C. for a treatment time of 1 to 30 minutes. If the treatment temperature is too low or the treatment time is too short, the degreasability may be insufficient. If the treatment temperature is too high or the treatment time is too long, on the other hand, chemical conversion property may be reduced when a zinc-based metal material is treated.

The inventive alkaline degreasing solution may be brought into contact with the target by dipping, spraying or a combination of dipping and spraying.

Waste water of the inventive alkaline degreasing solution can be readily treated by ordinary neutralizing coagulation. For example, the pH value of the waste water is reduced to less than 8 with proper acid, so that the nonionic surface-active agent is reacted in the waste water with the organic substance having a phenolic hydroxyl group and having a molecular weight of at least 500. An inorganic coagulant such as aluminum sulfate, iron sulfate, iron chloride or aluminum chloride is added under acidic conditions to the reactant, which in turn is neutralized with proper alkali so that its pH value is 5 to 7, whereby the reactant can be sedimented and separated. It is possible to further facilitate this sedimentation by employing an additional inorganic coagulant or an organic coagulant such as polyacrylamide.

The inventive alkaline degreasing solution previously contains the organic substance having a phenolic hydroxyl group with a molecular weight of at least 500, which is reacted with the nonionic surface-active agent upon the treatment of waste water. Further, according to the present invention, the organic substance is contained at a prescribed ratio to the nonionic surface-active agent. Therefore, it is not necessary to measure the concentration of the nonionic surface-active agent which is contained in the waste water as in the prior art, but an inorganic coagulant such as aluminum sulfate can be directly added to the waste water for carrying out neutralizing coagulation. When the pH value of the inventive alkaline degreasing solution is regulated to less than 8, the nonionic surface-active agent is reacted with the organic substance to be water-insoluble. Following such reaction, oil which is emulsified by the nonionic surface-active agent is isolated due to breaking of the emulsion. The isolated oil is adsorbed by the inorganic coagulant.

Further, the organic substance having a phenolic hydroxyl group with a molecular weight of at least 500, which is previously contained in the inventive alkaline degreasing solution, is sufficiently mixed and dispersed in the alkaline degreasing solution. Therefore, the organic substance is efficiently reacted with the nonionic surface-active agent in a short time. Thus, neither specific equipment nor a long time is required for stirring and mixing the organic substance, unlike the prior art of adding such an organic substance having a phenolic hydroxyl group for the waste water treatment. Consequently, it is possible to further improve the reduction of COD through employment of the inventive alkaline degreasing solution.

While the inventive alkaline degreasing solution contains the organic substance having a phenolic hydroxyl group, which is not contained in an alkaline degreasing solution in general, it has been recognized that substantially no bad influence of such an organic substance is exerted in later steps of chemical conversion, coating and the like. In general, it is beyond the knowledge of those skilled in the art to previously introduce the organic substance having a phenolic hydroxyl group with a molecular weight of at least 500, which is adapted to water-insolubilize and separate the nonionic surface-active agent, into the alkaline degreasing solution. However, the inventors have noted that the reaction between the organic substance and the nonionic surface-active agent is caused only at a pH value less than 8, and have found that it is possible to introduce the organic substance having a phenolic hydroxyl group with a molecular weight of at least 500 into the alkaline degreasing solution without causing reaction between the same and the nonionic surface-active agent by increasing the pH value of the solution to at least 8, preferably at least 10.5. It is amazing that the inventors have found that substantially no problem is caused in later steps such as chemical conversion when a target is degreased/cleaned with the alkaline degreasing solution containing such an organic substance having a phenolic hydroxyl group with a molecular weight of at least 500.

After degreasing with the inventive alkaline degreasing solution, therefore, it is possible to carry out a treatment such as chemical conversion as a later step with substantially no problem.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
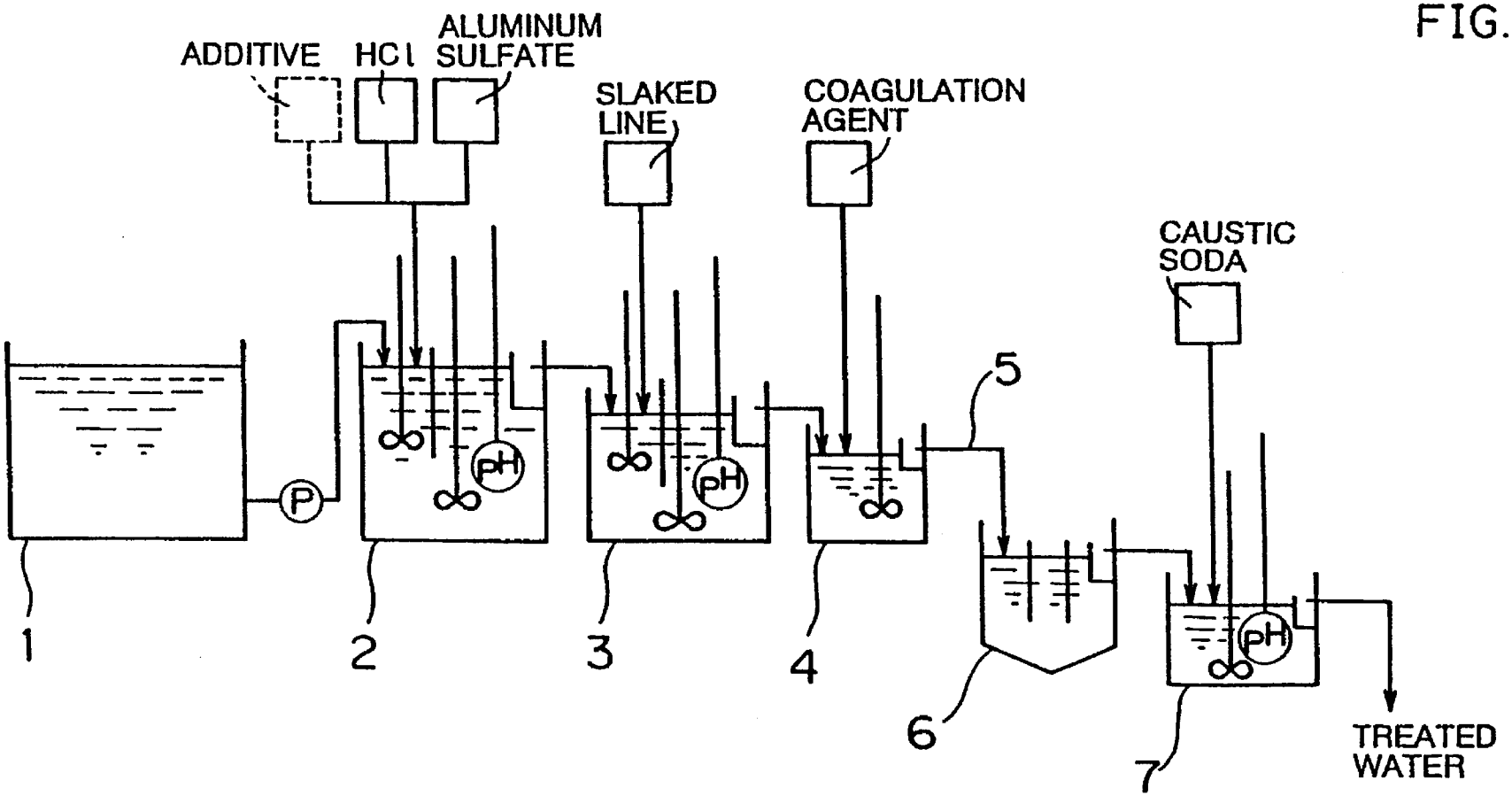
FIG. 1 is a schematic block diagram showing a waste water treatment step in Example of the present invention.

The present invention is now described with reference to Examples and comparative examples, while the present invention is not restricted to the following Examples.

EXAMPLES 1 TO 3 AND COMPARATIVE EXAMPLES 1 TO 3

Respective components were blended at the mixing rates shown in Table 1, to prepare alkaline degreasing solutions.

TABLE 1

| | Content (g/l) |
|---|---|
| Phenolic-Hydroxyl-Group-Containing Compound (Non-Volatile Matter) | 2 |
| Nonylphenol Ethoxylate | 2 |
| Sodium Metasilicate Pentahydrate | 12 |
| Anhydrous Sodium Pyrophosphate | 4 |
| Sodrum Carbonate | 2 |

Organic substances having phenolic hydroxyl groups (hereinafter referred to as phenolic-hydroxyl-group-containing compounds) were prepared as follows:

Phenolic-hydroxyl-group-containing Compounds

Example 1: Safener N (product by Dainippon Pharmaceutical Co., Ltd.: mainly composed of a condensate of formaldehyde and bis(hydroxyphenyl)sulfonemonomethyl sodium sulfonate with a molecular weight of 650)

Example 2: Condensate of dihydroxydiphenylsulfone and formaldehyde (molecular weight: 920, condensation number of phenol: 4)

Example 3: tannic acid (molecular weight: 2600, commercial reagent)

Comparative Example 1: phenol (molecular weight: 94, commercial reagent)

Comparative Example 2: condensate of phenol and formaldehyde (molecular weight: 2140, condensation number of phenol: 20)

Comparative Example 3: no addition

Water solubility and water dispersibility of the phenolic-hydroxyl-group-containing compounds employed in Examples 1 to 3 and comparative examples 1 to 3 were evaluated. Each phenolic-hydroxyl-group-containing compound was added to an aqueous solution having a pH value of at least 8, mixed with the aqueous solution for 10 minutes, allowed to stand still for 10 minutes, and thereafter visually observed for evaluation of the following three states:

Water Soluble State: water-solubilized in the aqueous solution.

Water Dispersible State: not water-solubilized but homogeneously dispersed.

Water Insoluble State: floated on or sedimented under the aqueous solution in a heterogeneous state.

Further, pH values of the alkaline degreasing solutions according to Examples 1 to 3 and comparative examples 1 to 3 were measured. Table 2 shows water solubility/water dispersibility and molecular weights of Examples 1 to 3 and comparative examples 1 to 3 and the pH values of the alkaline degreasing solutions as prepared therefrom.

TABLE 2

| | Example | | | Comparative Example | |
|---|---|---|---|---|---|
| | 1 | 2 | 3 | 1 | 2 |
| Water Solubility/ Water Dispersibility | Water Soluble | Water Soluble | Water Soluble | Water Soluble | Water Insoluble |
| Molecular Weight | 650 | 920 | 2600 | 94 | 2140 |
| pH | 13.2 | 13.2 | 12.9 | 12.9 | 13.2 |

The alkaline degreasing solutions of Examples 1 to 3 and comparative examples 1 to 3 prepared in the aforementioned manner were diluted to be 1/10 water dilute solutions which are corresponding to waste water after degreasing. 100 ml of each such water dilute solution was subjected to neutralizing coagulation treatment as follows:

Concentrated hydrochloric acid was dropped on 100 ml of each sample solution so that its pH value was adjusted to about 3, and thereafter aluminum sulfate was added to the sample solution to be 1000 ppm. The mixture was stirred for about 1 minute, and its pH value was adjusted to 5.0 with addition of a caustic soda solution. The precipitation as deposited was removed by filtering. The COD value of the filtrate was measured by Cr method, and was reduced to a COD value of the original concentrated solution after the neutralization treatment by the correction of the dilution ratio. Table 3 shows such COD values before and after the neutralization treatment, and COD reduction rates obtained by comparing the values before and after the neutralization treatment.

As another treatment, the original sample of Example 1 was subjected to neutralizing coagulation treatment except that the alkaline degreasing solution of Example 1 was not diluted with water and that aluminum sulfate was added to be 3000 ppm.

TABLE 3

| | COD (ppm) | | |
|---|---|---|---|
| | Before Neutralization | After Neutralization | COD Reduction Rate (%) |
| Example 1 (Dilute Solution) | 720 | 85 | i8 |
| Example 2 (Dilute Solution) | 660 | 180 | 73 |
| Example 3 (Dilute Solution) | 580 | 220 | 62 |
| Example 1 (Original Solution) | 7200 | 1300 | 82 |
| Comparative Example 1 (Dilute Solution) | 760 | 460 | 39 |
| Comparative Example 2 (Dilute Solution) | 760 | 365 | 52 |
| Comparative Example 3 (Dilute Solution) | 380 | 365 | 4 |

As clearly understood from Table 3, the COD value was extremely reduced by the neutralization treatment in the degreased waste water of each alkaline degreasing solution according to the present invention. Further, the COD reducing effect is also obtained in the waste water of the concentrated alkaline degreasing solution, which shows that the inventive alkaline degreasing solution can be treated without dilution.

Degreasability and Oil Contamination Resistance

Degreasability and oil contamination resistance were evaluated as to Examples 1 to 3 and comparative example 3.

Each alkaline degreasing solution was introduced into a stainless cylindrical vat and stirred at 40° C., so that an oil-coated cold-drawn steel plate of 7 cm by 15 cm was dipped in the alkaline degreasing solution contained in the vat for a prescribed time. The cold-drawn steel plate was then drawn out from the alkaline decreasing solution, washed with water and thereafter subjected to evaluation of degreasability of the degreasing solution by a wet area ratio (%).

6 g/l of preservative oil (Dafney Oil Coat Z-3: product by IDEMITSU KOSAN CO., LTD.) was added to each alkaline degreasing solution, so that a cold-drawn steel plate was dipped in this solution for 60 seconds similar to the above method of evaluating degreasability, washed with water and thereafter subjected to evaluation of oil contamination resistance of the degreasing solution through measurement of a wet area ratio (%).

Table 4 shows the values of degreasability and oil contamination resistance of Examples 1 to 3 and comparative example 3.

TABLE 4

| | Degreasability | Oil Contamination Resistance |
|---|---|---|
| Example 1 (Original Solution) | 100% | 100% |
| Example 2 (Original Solution) | 100% | 100% |
| Example 3 (Original Solution) | 100% | 100% |
| Comparative Example 3 (Original Solution) | 100% | 100% |

Influence in Surface Conditioning and Chemical Conversion

The cold-drawn steel plates which were degreased/cleaned with Examples 1 to 3 and comparative example 3 were surface-conditioned in the following manner and thereafter subjected to zinc phosphate treatment:

Surface Conditioning: Each sample was dipped in a surface conditioning agent (Surffine 5N-8: 0.1 wt. % titanium phosphate colloid aqueous solution by Nippon Paint Co., Ltd) at the room temperature for 10 seconds.

Zinc Phosphate Treatment: Each sample of the cold-drawn steel plate was dipped in zinc phosphate treatment solution (Surfdyne SD2500: nickel manganese type by Nippon Paint Co., Ltd. having total acidity of 20 points and free acidity of 0.8 point) at 42° C. for 2 minutes after the aforementioned surface conditioning.

After the aforementioned zinc phosphate treatment, the cold-drawn steel plates were washed with water and dried. Crystals of the zinc phosphate films on the cold-drawn steel plates were observed with an electron microscope, whereby it was confirmed that the cold-drawn steel plates which were degreased/cleaned with the alkaline degreasing solutions according to Examples 1 to 3 were coated with homogeneous and dense zinc phosphate films, similarly to the cold-drawn steel plate which was degreased/cleaned with the alkaline degreasing solution according to comparative example 3.

Thus, it was confirmed that substantially no influence is exerted on surface conditioning and zinc phosphate treatment by degreasing through the inventive alkaline decreasing solution.

EXAMPLES 4 AND 5 AND COMPARATIVE EXAMPLE 4

Respective components were blended at mixing rates shown in Table 5, to prepare alkaline degreasing solutions according to Examples 4 and 5 and comparative example 4. Phenolic-hydroxyl-group-containing compounds were prepared from "Safener N" (trade name), which is similar to Example 1. Water soluble polycarboxylate was prepared from "Adekacohol W-193" (product by Asahi Denka Kogyo K.K.). Further, ethoxypropyxylate of higher alcohol was prepared from Adekanol B714 (product by Asahi Denka Kogyo K.K.).

TABLE 5

| | Content (g/l) | |
|---|---|---|
| | Example 4 Comparative Example 4 | Example 5 |
| Phenolic-Hydroxyl-Group-Containing Compound (Non-Volatile Matter) | 0.5 | 1 |
| Ethoxypropyxylate of Higher Alcohol | 2 | 2 |
| Water Soluble Polycarboxylate (Non-Volatile Matter) | 1 | 0 |
| Sodium Metasilicate Pentahydrate | 4 | 4 |
| Sodium Carbonate | 10 | 10 |
| Sodium bicarbonate | 1.5 | 1.5 |

All alkaline degreasing solutions according to Examples and 5 and comparative example 4 obtained by blending the materials at the mixing rates shown in Table 5 exhibited pH values of 11.2.

Phosphoric acid was added to the alkaline degreasing solutions according to Example 4 and comparative example 4 to adjust the pH values to those shown in Table 6, thereby preparing Examples 4-1 to 4-4 and comparative example 4. The pH value of Example 4-1 was not adjusted.

TABLE 6

| | pH |
|---|---|
| Example 4-1 (Original Solution) | 11.2 |
| Example 4-2 (Original Solution) | 10.5 |
| Example 4-3 (Original Solution) | 10.0 |
| Example 4-4 (Original Solution) | 9.0 |
| Comparative Example 4 (Original Solution) | 7.5 |

The alkaline degreasing solutions of Examples 4-1 to 4-4 and comparative example 4 prepared in the aforementioned manner and Example 5 were subjected to evaluation of degreasability and oil contamination resistance respectively by a method similar to the above. Table 7 shows the results.

TABLE 7

| | | | Example | | | | Comparative Example | Example |
|---|---|---|---|---|---|---|---|---|
| | | | 4-1 | 4-2 | 4-3 (Original solution) | 4-4 | 4 | 5 |
| | oil | Contact Time | pH 11.2 | pH 10.5 | pH 10.0 | pH 9.0 | pH 7.5 | pH 11.2 |
| Degresability | 0 | 1 min. | 100 | 100 | 100 | 95 | 0 | 98 |
| | | 2 min. | 100 | 100 | 100 | 100 | 0 | 100 |
| Oil | 3 | 1 min. | 100 | 100 | 98 | 85 | 0 | 98 |
| Contamination | | 2 min. | 100 | 100 | 100 | 100 | 0 | 100 |
| Resistance | 6 | 1 min. | 100 | 100 | 90 | 50 | 0 | 98 |
| | | 2 min. | 100 | 100 | 100 | 80 | 0 | 100 |

It is clearly understood from Table 7 that comparative example 4 having a pH value of less than 8 completely lost its function with degreasability and oil contamination resistance of zero. It is also understood that the alkaline degreasing solutions having pH values in the range of not more than 10 were slightly inferior in oil contamination resistance.

Comparing Examples 4-1 and 5 with each other, it is possible to improve degreasability and oil contamination resistance by adding water soluble polycarboxylate to the alkaline degreasing solution.

Table 8 shows the results of neutralizing coagulation treatability of 1/10 dilute solutions which were prepared on the assumption of waste water after degreasing in relation to Examples 4-1 and 5.

TABLE 8

| | COD (ppm) | | COD |
|---|---|---|---|
| | Before Neutralization | After Neutralization | Reduction Rate (%) |
| Example 4-1 (Dilute Solution) | 555 | 33 | 94 |
| Example 5 (Dilute Solution) | 510 | 87 | 83 |

Comparing Examples 4-1 and 5 with each other, it is clearly understood that COD reducibility is improved by adding water soluble polycarboxylate to the alkaline degreasing solution.

EXAMPLE 6

FIG. 1 is a schematic block diagram showing a waste water treatment equipment employed in Example 6. As shown in FIG. 1, waste water is transferred from a stock solution vessel 1 to a reaction control vessel 2 so that HCl is added to attain a pH value of 2.5 and aluminum sulfate is continuously dropped into the reaction control vessel 2 to be 1000 ppm in concentration. Then, the waste water is transferred from the reaction control vessel 2 into a pH regulation vessel 3, so that slaked lime is added thereto to attain a pH value of 5.0. Then the waste water is transferred from the pH regulation vessel 3 to a coagulation vessel 4, so that polyacrylamide coagulation agent is added thereto to be 5 ppm for coagulation. Then the waste water is transferred from the coagulation vessel 4 to a precipitation vessel 6 to be precipitated therein, thereafter transferred to a neutralization vessel 7 to be neutralized to a pH value of 6.5 to 7 with addition of caustic soda, and thereafter discharged as treated water.

The capacities of the reaction control vessel 2, the pH regulation vessel 3, the coagulation vessel 4 and the precipitation vessel 6 are 40 l, 60 l, 30 l and 600 l respectively. The stock solution vessel 1 supplies the waste water to the reaction control vessel 2 at a flow rate of 40 l/min.

Assumed waste water (1/10 dilute solution) of an alkaline degreasing solution having a similar composition to Example 1 was introduced into the stock solution vessel 1 shown in FIG. 1 and transferred to the reaction control vessel 2, so that HCl and aluminum sulfate were added thereto in the aforementioned manner. Thereafter the waste water was transferred to and treated in the pH regulation vessel 3 and the coagulation vessel 4, and sampled at a sampling portion 5 in the passage toward the precipitation vessel 6, so that the sampled solution was filtered off for measurement of the COD value of the filtrate. The COD value was 82 ppm. The COD value of the waste water contained in the stock solution vessel 1 was 720 ppm, and hence the COD reduction rate was 89%.

COMPARATIVE EXAMPLE 5

Assumed waste water (1/10 dilute solution) of an alkaline degreasing solution which was similar to comparative example 3, i.e., an alkaline degreasing solution having the blending composition shown in Table 1 except that no phenolic-hydroxyl-group-containing compound was added thereto, was introduced into the stock solution vessel 1 shown in FIG. 1 and transferred to the reaction control vessel 2, so that "Safener N" serving as a phenolic-hydroxyl-group-containing compound was continuously dropped thereinto as an additive to be 200 ppm in concentration in terms of a non-volatile matter, with addition of HCl and aluminum sulfate similarly to Example 6. This waste water was transferred to and treated in the pH regulation vessel 3 and the coagulation vessel 4 similarly to the above, and sampled at the sampling portion 5 so that the sampled waste water was filtered off for measurement of the COD value of the filtrate. The COD value of the filtrate was 114 ppm. The COD value of the waste water contained in the stock solution vessel 1 was 380 ppm, and hence the COD reduction rate was 70%.

Comparing Example 6 and comparative example 5 with each other, it is clearly understood that the COD value is reduced when a phenolic-hydroxyl-group-containing compound is previously introduced into the alkaline degreasing solution in accordance with the present invention. This is conceivably because the phenolic-hydroxyl-group-containing compound which is previously added into the alkaline degreasing solution according to the present invention is homogeneously mixed with the nonionic surface-active agent to be efficiently reacted with the same, thereby remarkably reducing the COD value.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An alkaline degreasing aqueous solution comprising 0.01–10 g/l of a nonionic surface-active agent, and an organic substance exhibiting water solubility or water dispersibility at a pH value of at least 8, having a phenolic hydroxyl group with a molecular weight of at least 500, at a weight ratio of 0.1 to 2:1=(organic substance having a phenolic hydroxyl group):(nonionic surface-active agent), said alkaline degreasing solution having a pH value of at least 8, said organic substance being a condensate of formaldehyde and sodium salt of bis(hydroxyphenyl) sulfonemonomethylsulfonic acid.

2. The alkaline degreasing aqueous solution in accordance with claim 1, further containing at least one alkaline builder being selected from the group consisting of silicate, phosphate, condensed phosphate, carbonate and caustic alkali.

3. The alkaline degreasing aqueous solution in accordance with claim 2, containing silicate for serving as said alkaline builder in concentration of 0.1 to 1 g/l as Si concentration, 0.001 to 1 g/l of said organic substance having a phenolic hydroxyl group, and 0.01 to 10 g/l of said nonionic surface-active agent so that said organic substance having a phenolic hydroxyl group and said nonionic surface-active agent are at a weight ratio of 0.1 to 2:1=(organic substance having a phenolic hydroxyl group):(nonionic surface-active agent), said alkaline degreasing solution having a pH value of at least 10.5.

4. The alkaline degreasing aqueous solution in accordance with claim 1, further containing 0.01 to 10 g/l of water soluble polycarboxylate.

5. A method for treating a waste water alkaline degreasing solution which has been used to degrease a metal surface and comprises 0.01–10 g/l of a nonionic surface-active agent, and an organic substance exhibiting water solubility or water dispersibility at a pH value of at least 8, having a phenolic hydroxyl group with a molecular weight of at least 500, at a weight ratio of 0.1 to 2:1=(organic substance having a phenolic hydroxyl group):(nonionic surface-active agent), said alkaline degreasing solution having a pH value of at least 8, said organic substance being a condensate of formaldehyde and sodium salt of bis(hydroxyphenyl) sulfonemonomethylsulfonic acid, by the step comprising: adjusting a pH value of said alkaline degreasing aqueous solution to a pH of less than 8, wherein said nonionic surface-active agent is reacted with said organic substance in said waste water of said alkaline degreasing aqueous solution, thereby facilitating sedimentation of said nonionic surface-active agent and said organic substance.

6. The method of claim 5, wherein the alkaline degreasing aqueous solution further comprises at least one alkaline builder selected from the group consisting of silicate, phosphate, condensed phosphate, carbonate and caustic alkali.

7. The method of claim 5, wherein the alkaline degreasing aqueous solution contains silicate for serving as said alkaline builder in concentration of 0.1 to 1 g/l as Si concentration, 0.001 to 1 g/l of said organic substance having a phenolic hydroxyl group, and 0.01 to 10 g/l of said nonionic surface-active agent so that said organic substance having a phenol hydroxyl group and said nonionic surface-active agent are at a weight ratio of 0.1 to 2:1=(organic substance having a phenolic hydroxyl group):(nonionic surface-active agent), said alkaline degreasing aqueous solution having a pH value of at least 10.5.

8. The method of claim 5, wherein the alkaline degreasing aqueous solution further contains 0.01 to 10 g/l of water soluble polycarboxylate.

* * * * *